US006665971B2

(12) United States Patent
Lowry et al.

(10) Patent No.: US 6,665,971 B2
(45) Date of Patent: Dec. 23, 2003

(54) LABEL HOLDER WITH DUST COVER

(75) Inventors: Michael G. Lowry, Boca Raton, FL (US); Robert Fast, Ft. Lauderdale, FL (US)

(73) Assignee: Fast Industries, Ltd., Ft. Lauderdale, FL (US)

( * ) Notice: Subject to any disclaimer, the term of this patent is extended or adjusted under 35 U.S.C. 154(b) by 0 days.

(21) Appl. No.: 10/216,317

(22) Filed: Aug. 12, 2002

(65) Prior Publication Data

US 2003/0097775 A1 May 29, 2003

Related U.S. Application Data

(60) Provisional application No. 60/333,126, filed on Nov. 27, 2001.

(51) Int. Cl.[7] ..... G09F 3/18
(52) U.S. Cl. ..... 40/661; 40/661.03; 40/642.02
(58) Field of Search ..... 40/661, 649, 651, 40/658, 661.03, 642.02

(56) References Cited

U.S. PATENT DOCUMENTS

| | | | | |
|---|---|---|---|---|
| 4,557,064 A | | 12/1985 | Thompson | |
| 4,745,695 A | * | 5/1988 | Hetzer | 40/661 |
| 4,866,868 A | * | 9/1989 | Kass | 40/661 |
| 5,263,269 A | * | 11/1993 | Tjarnlund | 40/5 |
| 5,515,632 A | | 5/1996 | Gebka et al. | |
| 5,899,011 A | * | 5/1999 | Brinkman | 40/661.03 |
| 6,026,603 A | | 2/2000 | Kump et al. | |
| 6,035,569 A | | 3/2000 | Nagel et al. | |
| D423,592 S | | 4/2000 | Wamsley | |
| 6,082,687 A | | 7/2000 | Kump et al. | |
| 6,105,295 A | * | 8/2000 | Brinkman et al. | 40/661.03 |
| 6,119,990 A | | 9/2000 | Kump et al. | |
| 6,189,248 B1 | | 2/2001 | Nagel et al. | |
| D443,311 S | | 6/2001 | Wildrick | |
| 6,263,603 B1 | | 7/2001 | Wildrick | |
| 6,266,906 B1 | * | 7/2001 | Nagel | 40/661.03 |

FOREIGN PATENT DOCUMENTS

| | | |
|---|---|---|
| DE | 35 13 234 A | 10/1986 |
| DE | 87 09 128 U | 8/1987 |
| DE | 195 01 974 A | 7/1996 |

* cited by examiner

*Primary Examiner*—Gary Hoge
(74) *Attorney, Agent, or Firm*—Jacobson Holman PLLC

(57) ABSTRACT

A label holder including a transparent cover member overlying a main body panel to define therebetween a lockable label-receiving pocket. The cover member is normally biased to a closed position by a hinge interconnecting the lower edges of the cover member and the main body panel, and being movable about the hinge to an open position to spread a gap at the top of the pocket for insertion and removal of labels from the pocket. A dust cover is provided to span and seal the gap when the cover member is in its closed position without interfering with the locking feature.

6 Claims, 2 Drawing Sheets

LABEL HOLDER WITH DUST COVER

This is a complete application claiming benefit of provisional application Ser. No. 60/333,126 filed Nov. 27, 2001.

BACKGROUND OF THE INVENTION

1. Field of the Invention

This invention relates to plastic price channels of the kind used, for example, with merchandise display shelves in retail outlets such as supermarkets, drug stores, or the like, to receive labels providing information relating to merchandise being displayed on the shelves. More specifically, this invention is directed to a label holder with a transparent window or cover member of the type shown in commonly owned U.S. Pat. No. 5,515,632 issued May 14, 1996, the subject matter of which is incorporated herein in its entirety by reference (the '632 patent).

2. Description of the Related Art

In the '632 patent, the transparent cover member of a plastic label holder is hingedly and resiliently secured to the bottom of a main body panel to form a pocket between them for reception of a paper label or the like. The cover member has a height such that its top edge is releasably engaged or "locked" behind a downwardly extending lip on the top of the main body panel. A forwardly extending channel-shaped formation is provided along the top edge of the cover, comprising an inner downwardly extending limb and an outer upwardly extending limb between which the top lip of the main body panel is received when the cover is "locked" in position. The outer limb forms a gripping element by which the top edge of the cover can be disengaged from behind the top lip by finger pressure exerted from above, downwardly and outwardly on the upper edge of the outer limb. The construction of the '632 patent is inexpensive to manufacture and efficient in use. However, for certain applications it may be desirable to modify the structure to more effectively minimize the entry of dust and other extraneous matter into the label pocket, while retaining the ability to releasably "lock" the cover member to the main body panel to preclude accidental loss of a label carried within the pocket.

SUMMARY OF THE INVENTION

A primary object of this invention is the incorporation of a dust-inhibiting cover on a locking label holder with a transparent window.

More specifically, it is an object of this invention to provide a "dust cover" over the top of the label pocket formed behind a transparent cover member in a plastic price channel of the type described above to preclude dust or the like from entering the pocket and damaging the labels and/or the label holder or obscuring the information displayed by the label through the transparent cover member.

Yet another object of this invention is to provide different "dust cover" embodiments, each of which retain the ability to "lock" or secure the cover member to the main body panel while extending over the gap between the upper edges of each of these members to preclude or minimize the entry of foreign matter.

A still further object of this invention is to provide a dust cover overlying the gap at the top of the pocket in a "lockable" label holder of the type seen in the '632 patent, while retaining the ability of the label holder to open the pocket by finger pressure downwardly and outwardly on an element carried by the upper edges of the transparent cover member.

Other and further objects, features and advantages of the invention will become apparent from the ensuing description and claims taken in conjunction with the attached drawings.

BRIEF DESCRIPTION OF THE DRAWINGS

Like reference characters refer to like parts throughout the several views of the drawings.

DESCRIPTION OF THE PREFERRED EMBODIMENTS

Figure 1:
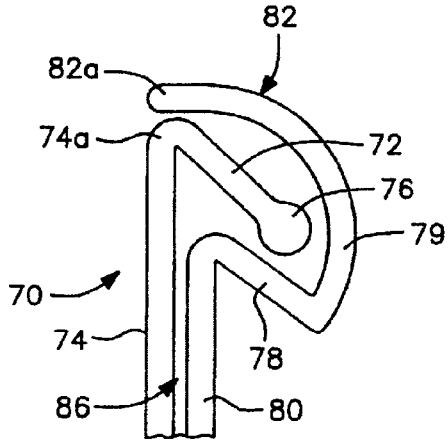
FIGS. 1–3 are fragmentary side elevational views of portions of three embodiments of dust covers adapted for use with a lockable label holder according to the instant inventive concepts.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

In the accompanying drawings, FIG. 1 shows the upper portions of a price channel 70 of the type seen in the '632 patent. As in the '632 patent, a downwardly directed lip 72 is provided on the main body panel 74 optionally terminating in an enlarged protrusion or knob 76. As seen, the terminus of the lip 72 is seated in the crotch formed between the downwardly depending limb 78 and the upwardly extending limb 79 of the locking/release elements formed on the upper end of the transparent label cover member 80. In this embodiment, however, the limb 79 extends arcuately as seen at 82 to provide a dust cover over the lip locking/release elements, with a terminal end portion 82*a* which can either rest on or frictionally engage the upper surface of the lip 72 preferably where it joins the upper edge 74*a* of the main body panel. In this manner, the gap formed at the top of the pocket 86 where a label (not shown) would be removably received is covered and sealed to preclude the entry of dust or the like.

Releasing engagement between the elements 72, 78 may still be provided by finger pressure exerted from above, downwardly and outwardly as seen in the '632 patent, in this instance, on the arcuate extension 82 of the limb 79. Thus, the ease of using the label holder of the '632 patent is retained, notwithstanding the incorporation of the dust cover 82.

Of course, the arcuate portion 82 may terminate short of the upper end 74*a* of the main body panel 74 and still be effective. For example, the lip 82*a* could engage the lip 72 intermediate the knob 76 and the connection at 74*a* (not shown).

Figure 2:
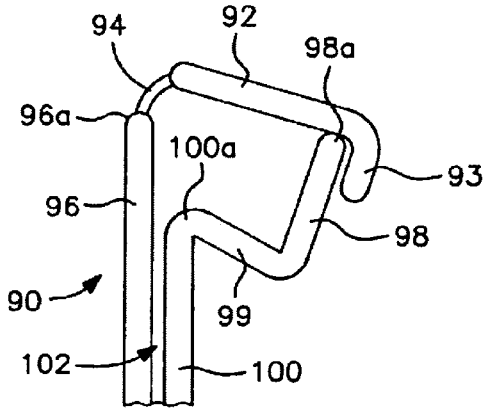

In the embodiment of FIG. 2, a price channel such as seen in the '632 patent is designated generally by the reference numeral 90 and is provided with a dust cover 92 connected by an integral hinge 94 to the upper end 96*a* of the main body panel 96 with a downwardly depending flange or finger 93 loosely resting over, or snappingly engaged with, the terminal end portion 98*a* of the limb 98 extending upwardly from the downwardly depending limb 99 formed at the top 100*a* of the transparent cover member 100. In this embodiment, the interengagement of the elements 93, 98 can lock the transparent cover member 100 in position with the dust cover 92 protecting the pocket 102 from contamination. The dust cover 92 can then simply be lifted upwardly and the limb 98 pressed downwardly and outwardly to open the transparent cover member 100 for removal of a label (not shown) from, and/or insertion of a label into, the pocket 102.

Figure 3:
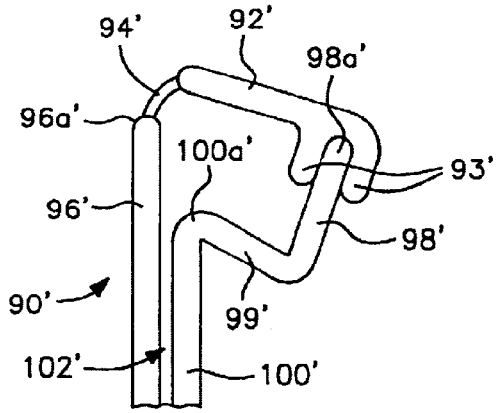

The embodiment of FIG. 3 is similar to the embodiment of FIG. 2 and like parts are designated by like reference characters followed by a prime (').  In this embodiment, the dust cover 92' has a pair of depending fingers 93' at its terminal end defining a pocket therebetween adapted to engage over, or frictionally engage with, the end 98*a*' of the upwardly extending limb 98' of the transparent cover member 100'.

Obviously, the various embodiments of engaging and disengaging elements and dust cover elements shown herein can be integrated into a single label holder. Moreover, other similar dust cover designs will be readily recognized by those skilled in this art and are to be included within the instant inventive concepts.

Figure 4:
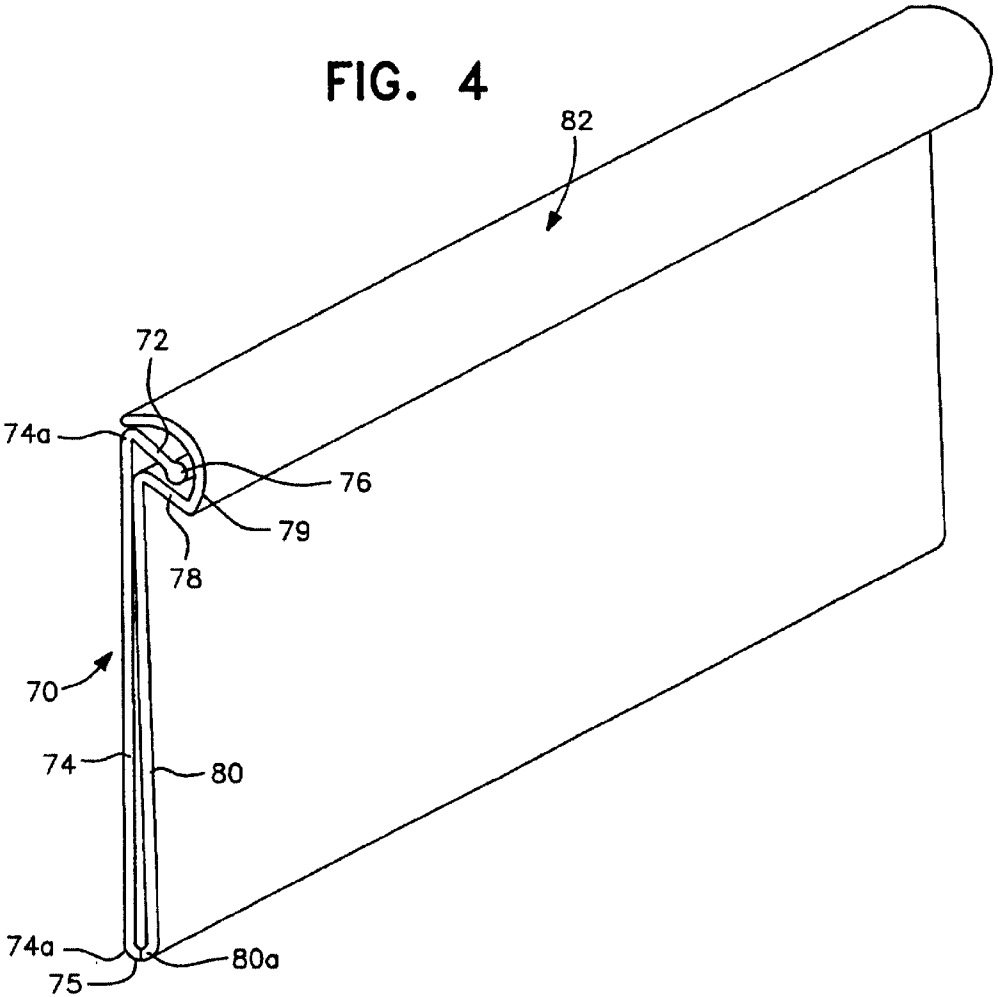
FIG. 4 is a perspective view of one form of label holder incorporating the dust cover embodiment of FIG. 1.

Further details of a label holder 70 with the dust cover elements of FIG. 1 are seen in FIG. 4 as illustrative. In this embodiment, the bottom edge 74*a* of the main body panel 74 and the bottom edge 80*a* of the transparent cover member 80 are integrally or co-extruded in a well known manner to form a resilient bight or hinge connection 75 enabling the cover member 80 to be tipped forwardly for access to the pocket 86 to insert or remove a paper or plastic label (not shown) when the dust cover 82 is disengaged from the main body panel 80, while biasing the upper portions of the cover member 80 toward the main body panel 74.

The elements 72 and 78 and the dust cover 82 are shown as extending along the full length of the label holder 70, an arrangement that is most convenient for extrusion of these elements and provides the best sealing against entry of dust or other extraneous matter into the pocket 86. However, it is to be understood that the instant inventive concepts are intended to cover constructions in which these elements are discontinuous.

Figure 5:
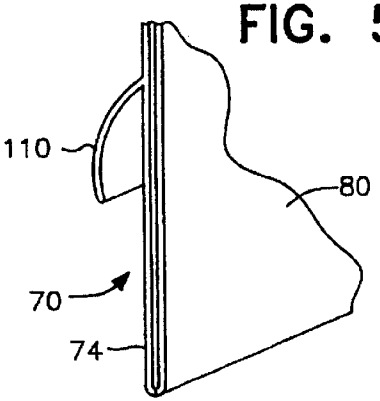
FIG. 5 is a partial fragmentary perspective view of a portion of a label holder such as seen in FIG. 4 showing a rearwardly depending leg for engagement in the lower lip of a C-channel on a merchandise shelf.
Figure 6:
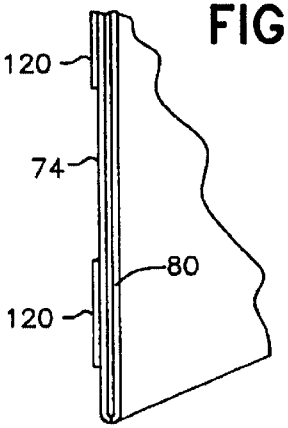
FIG. 6 is a partial fragmentary perspective view of an alternative label holder embodiment utilizing stripes of adhesive to secure the same to a supporting surface.

The means for engaging any of the label holder embodiments of this invention in a C-channel on a shelf or attaching the same to other surfaces can be similar to those described in the '632 patent and other well-known prior art label holders. For example, a barb (not shown) can be provided at the top edge of the main body panel 74 of the label holder 7 as seen in the '632 patent, particularly if the end portion 82*a* of the arcuate dust cover 82 engages the upper surface of the lip 72 intermediate the knob 76 and the connection at 74*a* as described above. The barb may be engaged in a downwardly depending lip at the top of a C-channel on the front of a merchandise shelf (not shown), with any mechanism, such as the downwardly depending element 110 shown on the back of the main body panel 74 in FIG. 5, engaged in the upwardly opening lip at the bottom of such a C-channel in a well known manner. Alternatively, as shown in FIG. 6, adhesive stripes 120 can simply be provided on the rear surface of the main body panel 74 to secure the label holder 70 to a supporting surface (not shown).

In summary, the mechanism for attaching the label holder to any supporting surface, whether it be a flat wall or shelf side surface, a C-channel integral with a shelf front edge, or separate therefrom, or other supporting surfaces, is not critical to the instant inventive concepts.

Moreover, any of the label holders of this invention can also be provided with an integral sign-holder (not shown) such as disclosed in co-pending application Ser. No. 10/101,726 filed Mar. 21, 2002, the subject matter of which is also incorporated herein in its entirety by reference.

The foregoing descriptions and drawings should be considered as illustrative only of the principles of the invention. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. In a plastic price channel for carrying and displaying merchandise labels, wherein the price channel comprises a main body panel having a top edge, a bottom edge, a front surface and a back surface, a transparent cover member having a top edge, a bottom edge, a front surface and a back surface, the bottom edges of the main body panel and the cover member being resiliently interconnected to define a hinge, a pocket being formed between the front surface of the main body panel and the back surface of the cover member, a gap defined at the top of the pocket, a forwardly extending channel-shaped formation along the top edge of the cover member comprising an inner downwardly extending limb and an outer upwardly extending limb, the cover member being movable about the hinge to an open position to spread the gap by finger pressure exerted from above downwardly and outwardly on the outer limb for removably receiving labels to be displayed through the cover member, the hinge normally biasing the cover member to a closed position when the finger pressure is removed, the improvement which comprises a dust cover spanning and sealing the gap when the cover member is in the closed position, wherein said dust cover comprises an arcuate extension of the outer limb on the cover member.

2. The improvement of claim 1 further including a resilient forwardly and downwardly extending top lip along the top edge of the body panel, said top lip having an upper surface, a lower surface and a free end portion, the cover member having a height such that a top edge of the cover member can be releasably engaged behind said top lip, said free end portion of said top lip being received between the limbs of the channel-shaped formation along the top edge of the cover member when the cover member is in the closed position, said arcuate extension of said outer limb forming said dust cover having a free end portion engaging said upper surface of said top lip to seal the gap.

3. The improvement of claim 2 wherein said free end portion of said arcuate extension of said outer limb engages said upper surface of said top lip at the point where said top lip joins the top edge of the main body portion.

4. In a plastic price channel for carrying and displaying merchandise labels, wherein the price channel comprises a main body panel having a top edge, a bottom edge, a front surface and a back surface, a transparent cover member having a top edge, a bottom edge, a front surface and a back surface, the bottom edges of the main body panel and the cover member being resiliently interconnected to define a hinge, a pocket being formed between the front surface of the main body panel and the back surface of the cover member, a gap defined at the top of the pocket, a forwardly extending channel-shaped formation along the top edge of the cover member comprising an inner downwardly extending limb and an outer upwardly extending limb, the cover member being movable about the hinge to an open position to spread the gap by finger pressure exerted from above downwardly and outwardly on the outer limb for removably receiving labels to be displayed through the cover member, the hinge normally biasing the cover member to a closed position when the finger pressure is removed, the improvement which comprises a dust cover spanning and sealing the gap when the cover member is in the closed position, wherein said outer limb has a free end portion and said dust cover has a first end hingedly secured to the top edge of the main body portion and a free second end engageable over said free end portion of said outer limb to seal the gap when the cover member is in the closed position.

5. The improvement of claim 4, wherein said free end portion of said dust cover includes a downwardly depending flange engageable over said free end portion of said outer limb.

6. The improvement of claim 5, wherein said free end portion of said dust cover includes a pair of spaced downwardly depending flanges defining a pocket therebetween, and said dust cover pocket is engageable over said free end portion of said outer limb.

* * * * *